United States Patent [19]

Matthynssens

[11] Patent Number: 4,737,333

[45] Date of Patent: Apr. 12, 1988

[54] METHOD FOR MANUFACTURING CONCRETE RAILWAY SLEEPERS

[75] Inventor: Frans H. Matthynssens, Ekeren, Belgium

[73] Assignee: P.V.B.A. Betonkonstruktie V.D. Hemiksem, Hemiksem, Belgium

[21] Appl. No.: 745,831

[22] Filed: Jun. 18, 1985

Related U.S. Application Data

[63] Continuation of Ser. No. 451,167, filed as PCT EP81/00001, Dec. 18, 1981, published as W082/02167, Jul. 8, 1982, abandoned.

[30] Foreign Application Priority Data

Dec. 24, 1980 [BE] Belgium ..... 2/58926
Oct. 6, 1981 [BE] Belgium ..... 2/59402

[51] Int. Cl.[4] ..... B28B 23/22; E01B 3/36

[52] U.S. Cl. ..... 264/251; 238/88; 249/86; 249/97; 264/254; 264/263; 264/274; 264/275; 264/279

[58] Field of Search ..... 264/263, 274, 275, 279, 264/333, 228, 251, 254, 71; 249/86, 91, 97; 425/111, DIG. 122, DIG. 130; 52/677, 678; 238/30, 84, 85, 88, 91, 349

[56] References Cited

U.S. PATENT DOCUMENTS

| | | | |
|---|---|---|---|
| 1,229,365 | 6/1917 | Wiegand | 52/677 |
| 1,580,485 | 4/1926 | Hahn | 249/91 |
| 2,382,139 | 8/1945 | Cueni | 264/228 |
| 2,656,115 | 10/1953 | Sonneville | 249/86 |
| 3,190,607 | 6/1965 | Sonneville | 249/91 |
| 3,471,118 | 10/1969 | Bormann et al. | 249/86 |
| 3,764,066 | 10/1973 | Kowell | 249/86 |
| 3,854,258 | 12/1974 | Colado et al. | 425/111 |
| 4,204,660 | 5/1980 | Feuillade | 249/86 |
| 4,242,071 | 12/1980 | Stinton | 425/111 |
| 4,290,991 | 9/1981 | Thim | 249/86 |

FOREIGN PATENT DOCUMENTS

| | | | |
|---|---|---|---|
| 2433016 | 1/1975 | Fed. Rep. of Germany . | |
| 1047105 | 12/1953 | France . | |
| 1429382 | 2/1966 | France . | |
| 7903569 | 11/1980 | Netherlands | 238/349 |

*Primary Examiner*—Jay H. Woo
*Attorney, Agent, or Firm*—Schwartz, Jeffery, Schwaab, Mack, Blumenthal & Evans

[57] ABSTRACT

Method includes placement of rail-clamps in a concrete mould, while securing elements thereof on the outside of the mould. Concrete reinforcement members are placed on the clamps. A connecting rod is introduced through a mould opening and the mould thereafter is filled with concrete and treated by vibration.

5 Claims, 2 Drawing Sheets

METHOD FOR MANUFACTURING CONCRETE RAILWAY SLEEPERS

This application is a continuation of application Ser. No. 451,167, filed as PCT EP81/00001 on Dec. 18, 1981, published as WO82/02167 on Jul. 8, 1982, now abandoned.

The present invention relates to a method for manufacturing railway sleepers made of reinforced concrete, as well as the elements used for carrying out said method, and more particularly to a method for manufacturing concrete sleepers in which is incorporated, when concreting, a portion of a clamping device combined for securing the rails, e.g. the device described in the Belgian Pat. No. 882,165 of the Applicant and called hereafter "rail-clamp".

It is known that the manufacture of railway sleepers made of reinforced concrete is carrying out by means of a mould in which are disposed and duly secured the said portions of the concerned clamping device, at least the upper reinforcement of the concrete sleeper being made being then disposed in the lower portion of the mould, said reinforcement being secured by means of temporary supporting elements which are introduced through the wall of the mould and which are removed only at the vibrating stage of the concrete or even at the end of this stage with the double purpose, on one hand, to maintain said reinforcement at the required level and, on the other hand, to fill up the recesses formed by said supporting elements at the end of the vibrating stage.

Needless to point out that this known method is not very practical and additionally not very economical not only owing to the numerous required interventions, but also owing to the wear to which said movable supporting elements are subjected within the concrete.

Attempts have already been made to avoid said known method, thereby preventing the above mentioned drawbacks by providing the bottom of the mould with spacing elements of very simple design made of any suitable material and intended for securing the reinforcement elements at the required mutual spaces like in the road construction. However, this solution has a drawback in that the said spacing elements are still visible when the sleeper is finished and, in some cases, they allow the penetration of moisture down to the reinforcement with all the resulting detrimental consequences, i.e. the corrosion of the reinforcement and, accordingly, an undue weakening of the so manufactured sleeper.

Now, the present invention relates to a method and a device for the implementation thereof in order to prevent the drawbacks of the known methods or devices.

For this purpose, the solution according to the invention comprises essentially mounting, through openings provided in the bottom of the mould, two portions or elements of a rail-clamp supporting the upper reinforcement of the sleeper; securing said elements outside the mould; and, if required, disposing an intermediate reinforcement on the upper reinforcement; introducing a connecting rod through an opening of the wall of the mould; and filling up the mould with concrete, the lower reinforcement being incorporated as usually at a due time and the assembly being finally compacted by vibration.

The elements used for the implementation of the method according to the invention outlines in the foregoing and being essentially under the form of the said stationary portions of the rail-clamp proper incorporated into the concrete are elements made of steel or cast iron so that, in the first alternative, at least the upper reinforcement is suitable secured, e.g. by welding, to said elements whereas, in the second alternative, said elements are provided with at least two supports for the upper reinforcement of the sleeper.

The characteristics and advantages of the solution according to the invention will be more clearly apparent from the following detailed description of some embodiments given by way of example and without any limitation, reference being made to the enclosed drawings in which.

Figure 1:
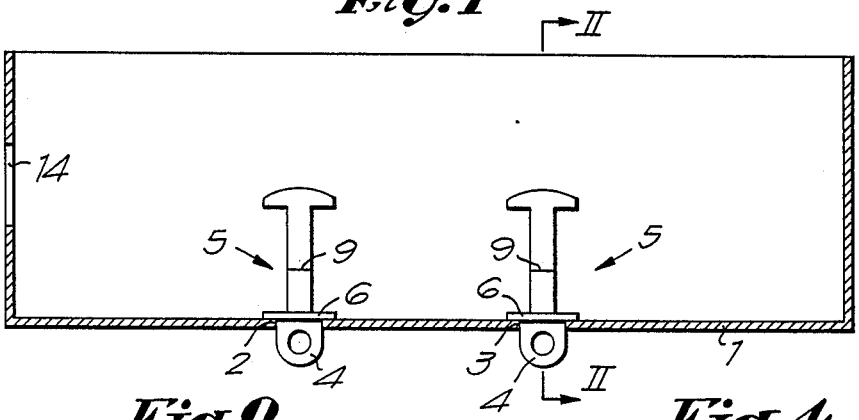
FIG. 1 shows a longitudinal vertical section of a mould for implementing the method according to the invention.
Figure 2:
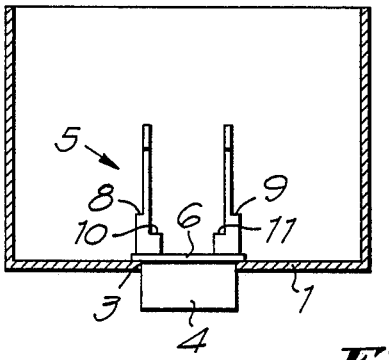
FIG. 2 shows a section taken on the line II—II of FIG. 1.
Figure 4:
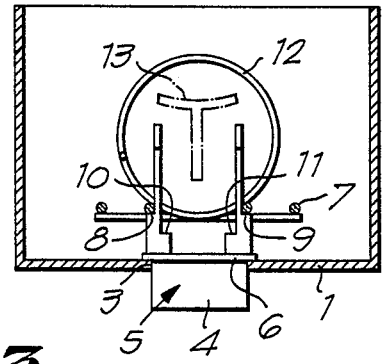
FIG. 4 shows a section taken on the line IV—IV of FIG. 3.
Figure 3:
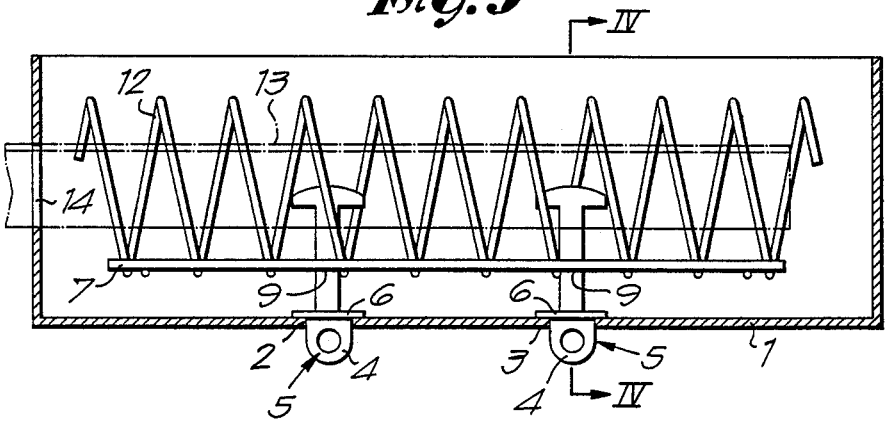
FIG. 3 shows a section similar to that of FIG. 1, but after having disposed the upper reinforcement of the sleeper as well as an intermediate reinforcement in the mould.

FIG. 1 shows a mould 1 the lower portion of which is provided with openings 2 and 3 in which may be suitably disposed the portions 4 of the lower elements 5 of a rail-clamp, said portions projecting normally from the sleeper. Said elements 5 are provided with a flange 6 which is provided for simply and efficiently securing them in the said openings 2 and 3.

Said elements are also secured outside the mould 1 (not shown).

The upper reinforcement 7 of the sleeper being made is then introduced in the mould 1 and it is disposed on a support 8 and 9 respectively of each element 5, thereby setting and economically maintaining the required spacing of said reinforcement relative to the bottom of the mould 1.

According to the invention, each element 5 has not only the said supports 8 and 9, but also the additional inner supports 10 and 11. Said supports, i.e. either the supports 8 and 9 like in the example here shown, or the additional supports 10 and 11 are provided for supporting a reinforcement respectively according to the nature of the sleeper or according to the nature of the used reinforcement which may be required.

On said reinforcement 7, is then disposed a helical reinforcement or similar 12 through which is inserted a connecting rod 13 introduced through one opening 14 of the concerned wall of the mould 1, said rod being used for connecting two portions provided in the mould 1 and mutually spaced from the required distance.

The mould 1 is now ready for concreting. The concrete poured therein is duly vibrated, whereafter a lower reinforcement 15 may be possibly embedded therein.

From the foregoing, it is seen that there is thereby obtained not only a particularly simple and efficient method for manufacturing railway sleepers made of reinforce concrete, but also a very simple and practical concreting mould in which the upper reinforcement 7 is duly secured without any possibility of being shifted and under optimum circumstances at the required distance from the bottom of the mould 1 by means of elements integral with the rail-clamp and provided with suitable supports for the reinforcement.

Figure 5:
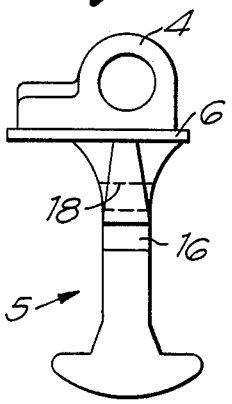
FIGS. 5 and 6 show respective a front view and a side view of an element according to the invention.
Figure 6:
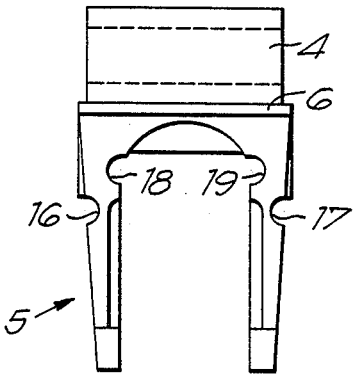

FIGS. 5 and 6 show a preferred embodiment of the elements 5. It is seen that the supports 8, 9, 10 and 11 are under the form of notches 16, 17, 18 and 19 respectively in which are engaged the corresponding portions of the reinforcement which is thereby not only duly supported, but also simultaneously well secured and prevented from any shifting whatever the circumstances may be.

Figure 7:
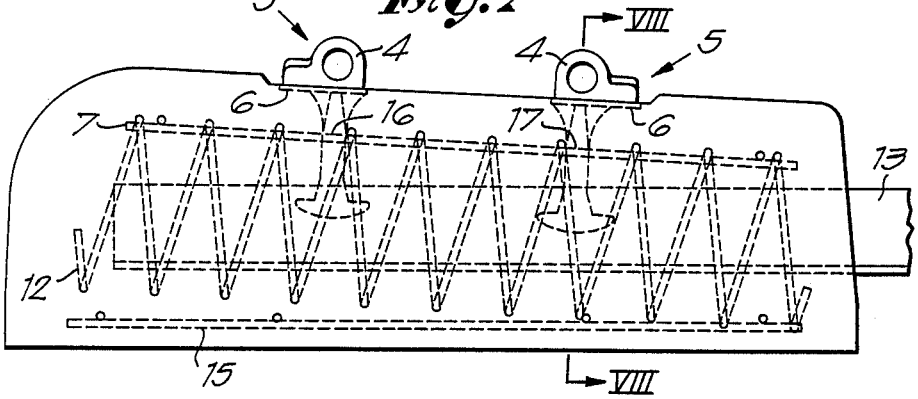
FIG. 7 shows a side view of one of the ends of a sleeper made of reinforced concrete and manufactured by the method and with the elements according to the invention.
Figure 8:
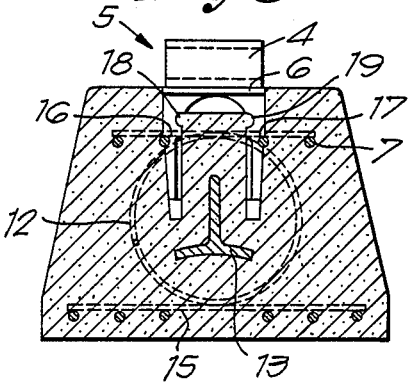
FIG. 8 shows a section taken on the line VIII—VIII of FIG. 7.

Finally, FIGS. 7 and 8 show by way of example a railway sleeper manufactured by the method and by means of the elements according to the invention, i.e. more particularly by means of the elements shown in FIGS. 5 and 6.

As regards the embodiments described in the foregoing, the said elements 5 are generally parts made of cast iron. On the contrary, should said elements 5 be steel parts, the supports 8, 9, 10 and 11 or 16, 17, 18 and 19 may be suppressed owing to the fact that the reinforcement 7 is secured to the elements 5, e.g. by spot welding, before introducing said elements in the mould.

In fact, the spot welding of the reinforcement to the elements 5 outside the mould 1 is merely carried out by disposing said elements in a temporary support nearby the supports carrying the reinforcement at the required level relative to the elements during the spot welding. The elements 5 which are thereby connected through the reinforcement 7 are then introduced as such in the mould 1, so that the manufacturing process may be continued as above described.

Needless to say that the invention is not limited to the above described embodiments, but that any variation, addition and adaptation relative to the shape and the sizes of the concerned sleeper made by means of the said elements may be provided, provided of course that the general principle thereof be respected without going outside the limits thereof as defined by the following claims.

I claim:

1. A method for manufacturing railway sleepers of reinforced concrete using moulds, said method comprising the steps of:

disposing a first pair of rail-clamps (5) in a pair of rail-clamp openings (2,3) through the bottom of a first mould (1) with rail-clamp portions (4) extending through said openings to the outside of said first mould and with reinforcement-supporting legs (8,9) of said rail-clamps projecting into said first mould;

disposing a second pair of rail clamps in a pair of rail clamp openings through the bottom of a second mold with rail clamp portions extending through said openings in said second mold to the outside of said second mold and with reinforcement-supporting legs of said rail clamps projecting into said second mold;

fitting at least one reinforcing member (7) on said reinforcement-supporting legs of each of said rail-clamps of each of said molds by securingly engaging convexly curved portions of said reinforcing members (7) in correspondingly concavely curved edge portions of said reinforcement-supporting legs introducing a connecting rod (13) through an openings (14) in the wall of each said mould to interconnect said first and second pairs of rail clamps; and filling said first and second moulds with concrete to form an assembly in which said reinforcement-supporting legs of said rail-clamps and said reinforcing members are permanently embedded in concrete.

2. A method according to claim 1, wherein said supporting legs are provided in pairs and said reinforcing members are fitted in concavely curved edge portions of said pairs of supporting legs.

3. A method according to claim 2, wherein said reinforcing members (7) are fitted in concavely curved edge portions (18, 19) on mutually facing inner sides of the legs of each pair of legs.

4. A method according to claim 2, wherein said legs have inner and outer sides, and said reinforcing members (7) are fitted in concavely curved edge portions (16, 17) on the outer sides of the legs of each pair of legs.

5. A method according to claim 2, wherein said concavely curved edge portions are symmetrically arranged on opposite sides of a plane extending centrally between the legs of each pair of legs.

* * * * *